US006935661B1

(12) United States Patent
Farnsworth et al.

(10) Patent No.: US 6,935,661 B1
(45) Date of Patent: Aug. 30, 2005

(54) ACCESS PANEL LATCHING SYSTEM

(75) Inventors: Arthur K. Farnsworth, Houston, TX (US); Peter W. Austin, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 626 days.

(21) Appl. No.: 09/717,544

(22) Filed: Nov. 21, 2000

(51) Int. Cl.[7] ..... E05C 1/04; E05C 1/10

(52) U.S. Cl. ..... 292/162; 312/223.2; 292/175; 292/128; 292/120

(58) Field of Search ..... 292/162, 175, 292/120, 128, 301; 312/223.2, 223.1; 361/724–727; 70/67, 70, 58, 63

(56) References Cited

U.S. PATENT DOCUMENTS 2,878,389 A * 3/1959 Raffman ..... 250/68
3,634,732 A * 1/1972 Finger et al. ..... 361/726
3,677,196 A * 7/1972 Schuller ..... 105/377
4,962,800 A * 10/1990 Owiriwo ..... 150/118
5,465,191 A * 11/1995 Nomura et al. ..... 361/681
5,588,728 A * 12/1996 Eldridge et al. ..... 312/332.1
5,704,661 A * 1/1998 Takimoto ..... 292/162
5,743,606 A * 4/1998 Scholder ..... 312/223.2
5,754,396 A * 5/1998 Felcman et al. ..... 361/683
5,785,398 A * 7/1998 Park ..... 312/223.2
6,055,152 A * 4/2000 Felcman et al. ..... 361/683
6,068,307 A * 5/2000 Murphy ..... 292/302
6,095,574 A * 8/2000 Dean ..... 292/164
6,134,116 A * 10/2000 Hoss et al. ..... 361/747
6,205,020 B1 * 3/2001 Felcman et al. ..... 361/683
6,351,379 B1 * 2/2002 Cheng ..... 361/685
6,353,968 B1 * 3/2002 Shyu et al. ..... 16/334
6,398,325 B1 * 6/2002 Chen et al. ..... 312/223.2
6,424,524 B2 * 7/2002 Bovio et al. ..... 361/686
6,570,755 B2 * 5/2003 Curlee et al. ..... 361/683

* cited by examiner

*Primary Examiner*—John B. Walsh

(57) ABSTRACT

A protective assembly for electronic components. The protective assembly has a chassis and a removable cover. The removable cover is secured to the chassis by a latch and a catch. The catch is biased by a spring to a first position. The latch slidingly engages the catch to displace the catch during the installation of the cover. The spring returning the catch to the first position when the cover is disposed on the chassis in the securing position. The panel being removeable by sliding the catch against the spring to release the latch from the catch.

25 Claims, 5 Drawing Sheets

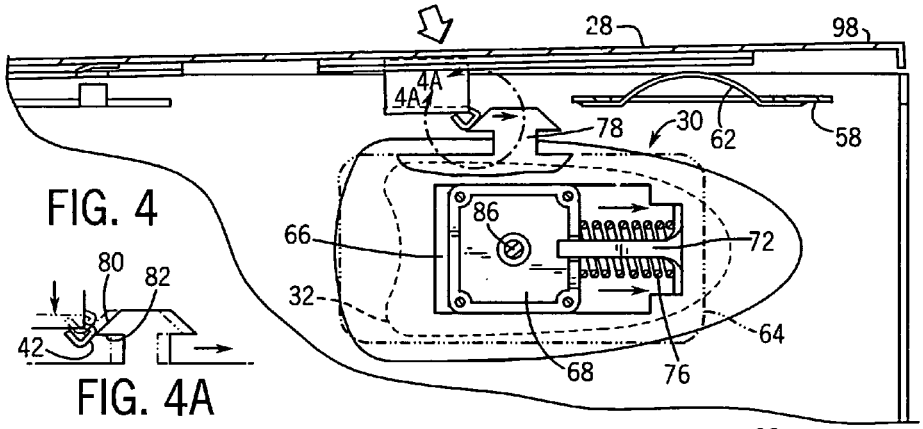
FIG. 4
FIG. 4A
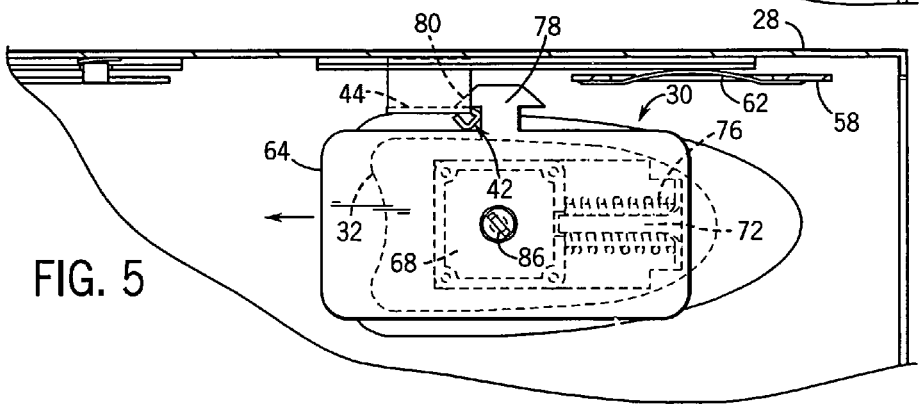
FIG. 5
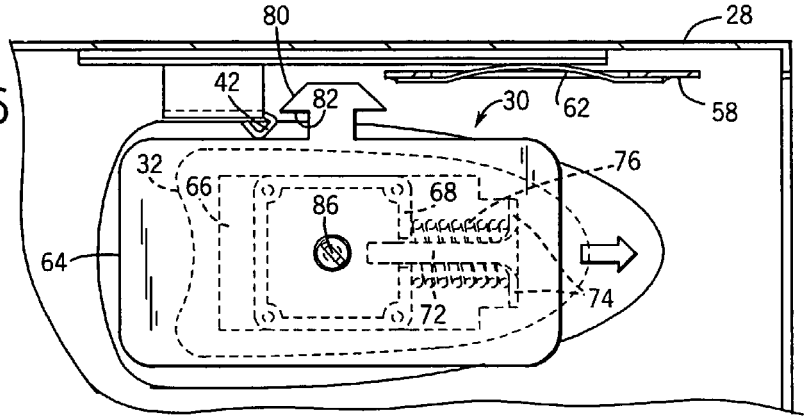
FIG. 6
FIG. 6A
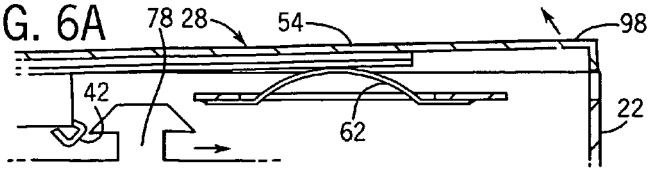

FIG. 8
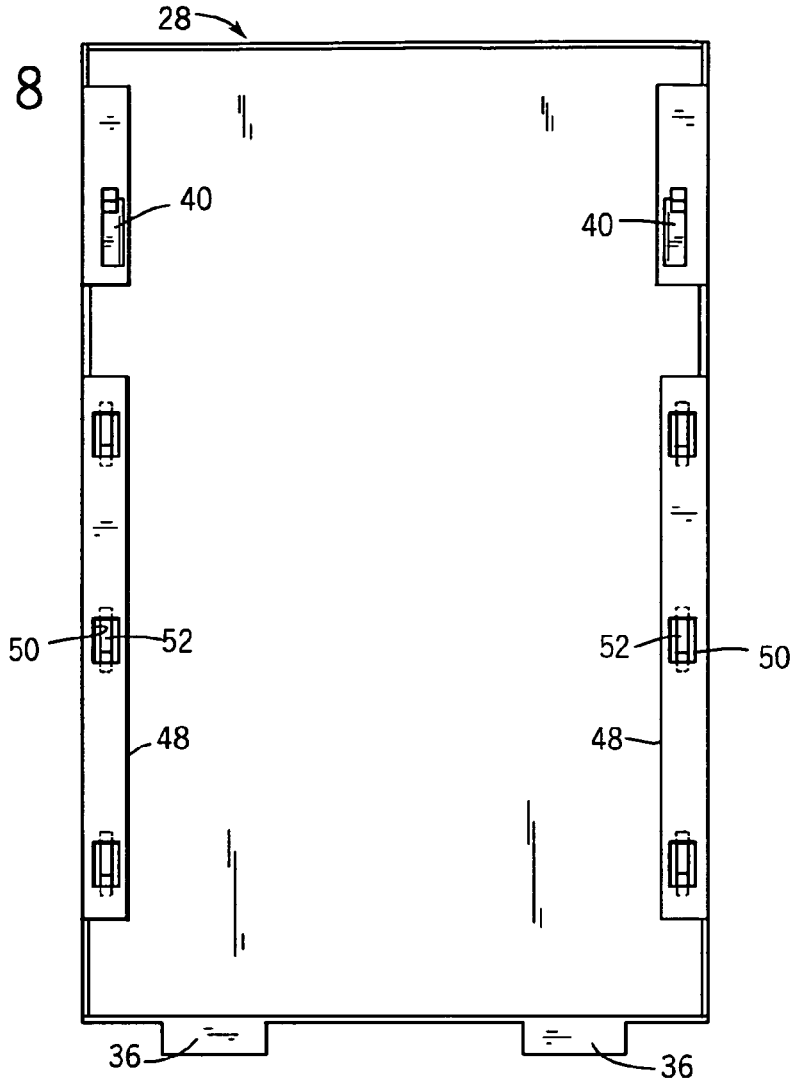
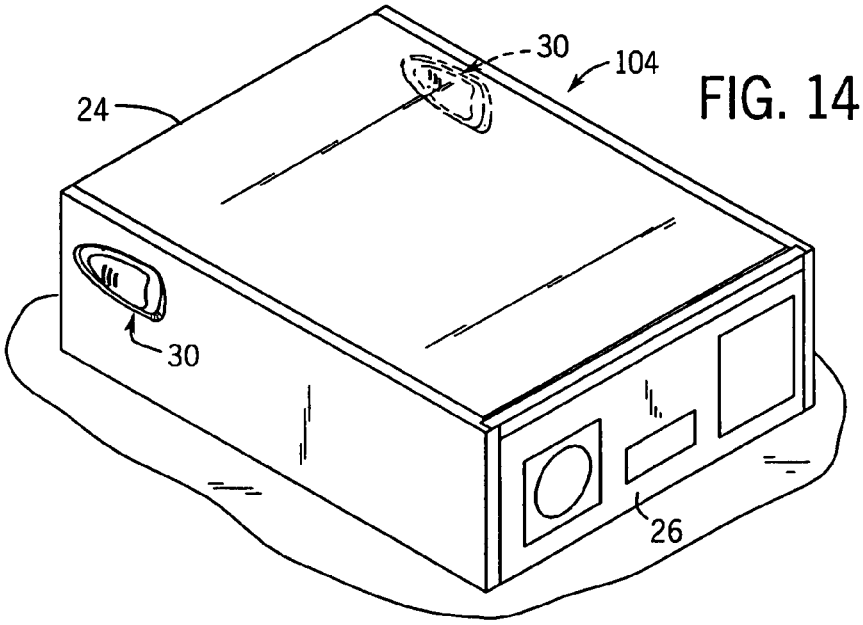
FIG. 14

ACCESS PANEL LATCHING SYSTEM

FIELD OF THE INVENTION

The present invention relates generally to a system and method for protecting components within an enclosure, and particularly to a system for accessing electronic components housed within a protective enclosure.

BACKGROUND OF THE INVENTION

Many electronic devices are composed of electronic components electrically coupled together within a protective enclosure. For example, the central unit of a desktop computer system typically consists of a microprocessor, hard drive, RAM, and power supply housed within a sheet metal enclosure. The central unit is typically coupled to a monitor, keyboard, printer, and mouse.

Protective enclosures for housing electronic components come in a variety of shapes and sizes. However, typically, they consist of a chassis with a removable cover. A cover is typically secured to the chassis by a number of screws. Occasionally, the components within the protective enclosure need to be accessed, either for repair or upgrade. To remove the cover and access the components, the screws securing the cover to the chassis must be removed. A tool, such as a screwdriver or drill, is needed to remove the screws from the enclosure. Additionally, installing and removing the screws consumes time, and the screws may be lost, adding additional time to the process.

Therefore, it would be advantageous to have a system that would allow access to the interior of a protective enclosure quickly, without the use of tools and producing no loose parts.

SUMMARY OF THE INVENTION

A protective assembly for a computer system is featured. The protective assembly includes a chassis, an access panel, a latch member and a catch member. The latch member is secured to the access panel. The catch member is movably secured to the chassis and is biased by a spring to a first position on the chassis to secure the latch member.

According to another aspect of the present invention, a first member securable to a second member to form a moveable securing mechanism for securing a latch member to a chassis is featured. The first member includes a first surface configured for sliding engagement with the latch member as the access panel is pivoted towards a closed position on the chassis. The first member also includes a second surface configured to restrict movement of the latch member when the access panel is disposed in the closed position on the chassis.

According to another aspect of the present invention, a method of securing an access panel to a chassis is provided. The access panel has a latch member and the chassis has a moveable catch member biased to a first position on the chassis. The method includes the step of pivoting a first end of the access panel towards a closed position on the chassis. The method also includes the step of displacing the moveable catch member from the first position with the latch member. The method further includes the step of disposing the access panel in the closed position on the chassis. The moveable catch member is no longer displaced by the latch member and is biased back to the first position, thereby securing the latch member.

BRIEF DESCRIPTION OF THE DRAWINGS

The invention will hereafter be described with reference to the accompanying drawings, wherein like reference numerals denote like elements, and:

FIG. 4 is a cross-sectional view similar to FIG. 3, illustrating the operation of the access panel securing system during the closing of the access panel;

FIG. 4A is a cross-sectional view of the area defined by line 4A—4A of FIG. 4;

FIG. 5 is a cross-sectional view similar to FIG. 3, illustrating the operation of the access panel securing system once the access panel is closed;

FIG. 6 is a cross-sectional view similar to FIG. 3, illustrating the operation of the access panel securing system during the opening of the access panel;

FIG. 6A is a cross-sectional view illustrating the operation of the leaf spring in opening the access panel;

FIG. 8 is a bottom elevational view of an access panel, according to a preferred embodiment of the present invention;

FIG. 14 is an alternative exemplary embodiment of a protective enclosure for a computer system.

DETAILED DESCRIPTION OF THE PREFERRED EMBODIMENTS

Figure 1:
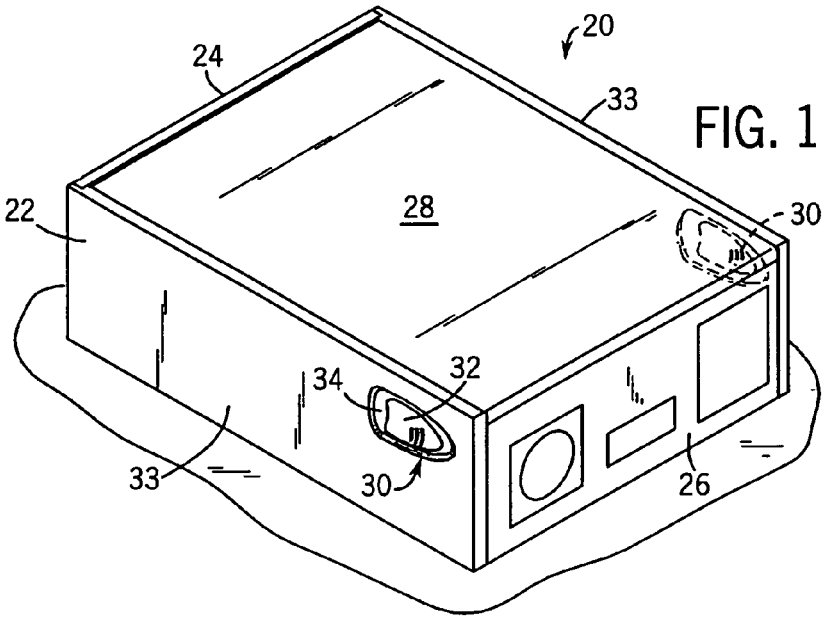
FIG. 1 is a perspective view of a protective enclosure for a computer system, according to a preferred embodiment of the present invention.

Referring generally to FIG. 1, a computer system enclosure 20 is featured. Enclosure 20 includes a chassis 22, a front bezel 24, a rear panel 26, an access panel 28, and two moveable catches 30 for securing access panel 28 to chassis 22. Each movable catch 30 is operated by a catch release 32 accessible from the exterior of chassis 22. In the illustrated embodiment, each moveable catch 30 is disposed on two sides 33 of chassis 22, towards rear panel 26. Each catch release 32 is disposed in a recess 34 in each side 33 so as to minimize the profile of catch release 32. In the illustrated embodiment, access panel 28 is released from chassis 22 by sliding both catch releases 32 towards rear panel 26.

Figure 2:
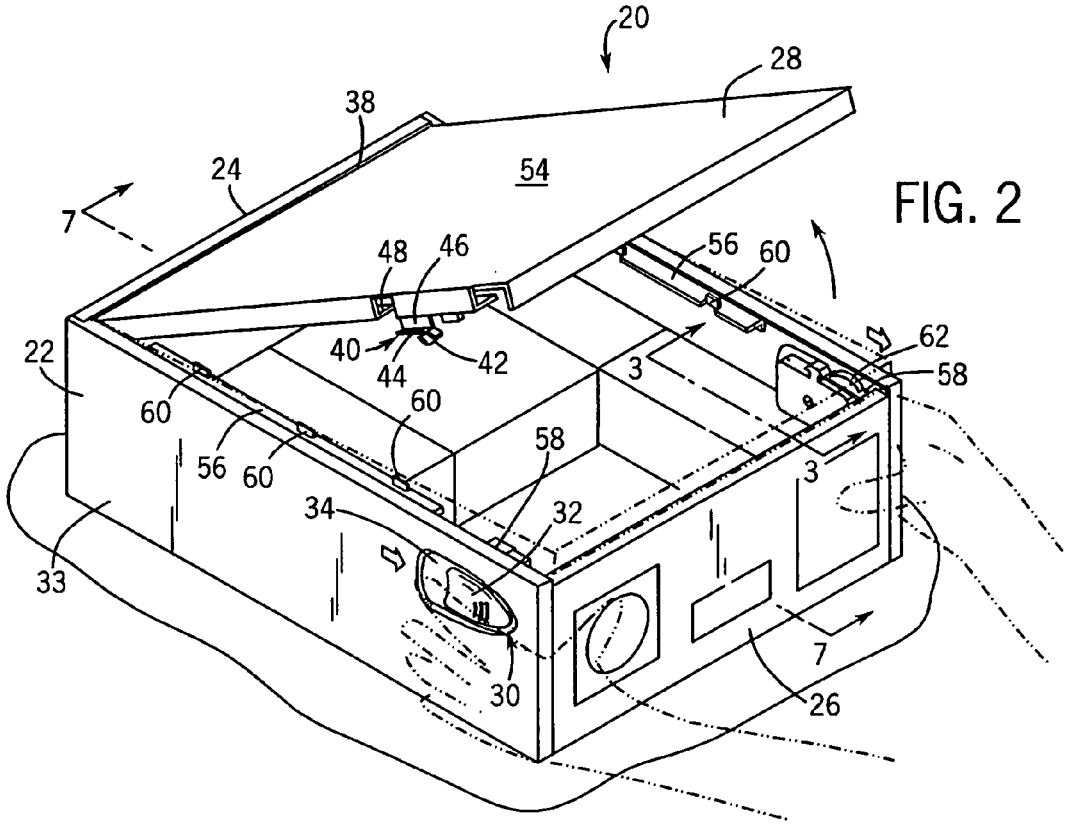
FIG. 2 is a perspective view of the protective enclosure of FIG. 1 featuring an access panel in an open position.

Referring generally to FIG. 2, chassis 22 is illustrated with access panel 28 in an open, or unsecured, position. The closed, or secured, position of panel 28 is shown in dashed lines. As best illustrated in FIG. 8, access panel 28 includes two tabs 36 used to secure access panel 28 to chassis 22. Alternatively, access panel 28 may be configured with one tab, or more than two tabs.

Referring again to FIG. 2, to secure access panel 28 to chassis 22 each tab 36 is seated under a lip 38 on the top rear portion of front bezel 24. Lip 38 and tabs 26 enable access panel 28 to be pivoted into the closed position. However, lip 38 prevents movement of tabs 36 when access panel 28 is in the closed position on chassis 28. Alternatively, the end of access panel 28 proximate front bezel 24 can be secured to chassis 22 by another mechanism, such as a hinge.

FIG. 2 also illustrates latch 40 of access panel 28. Chassis 22 and access panel 28 are preferably formed of sheet metal with latch 40 being formed by a series of bending operations on access panel 28. However, latch 40 can also be formed separately. Latch 40 includes an angled latch portion 42, a flat latch portion 44, and a connecting member 46.

Access panel 28 also includes two support rails 48 that extend along the sides of panel 28. As best illustrated in FIG. 8, each support rail 48 includes a plurality of holes 50. A ground spring 52 is disposed between each hole 50 and the main cover portion 54 of access panel 28. Each rail 48 rests on a first bracket surface 56 and a second bracket surface 58 on each side 33 of chassis 22. First bracket 56 includes a plurality of ground tabs 60. Each ground tab 60 is configured for insertion through each hole 50 of access panel 28 so as to contact ground spring 52 and ground access panel 28 to chassis 22. Second bracket 58 is configured with a leaf spring 62 to bias access panel 28 to an open position.

Figure 3:
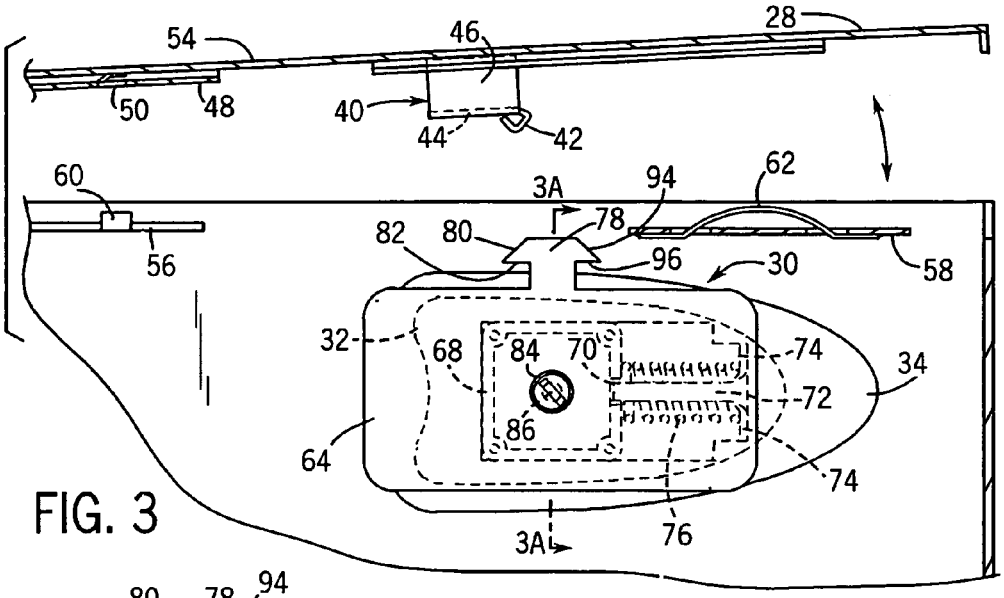
FIG. 3 is a cross-sectional view taken along line 3—3 of FIG. 2.
Figure 11:
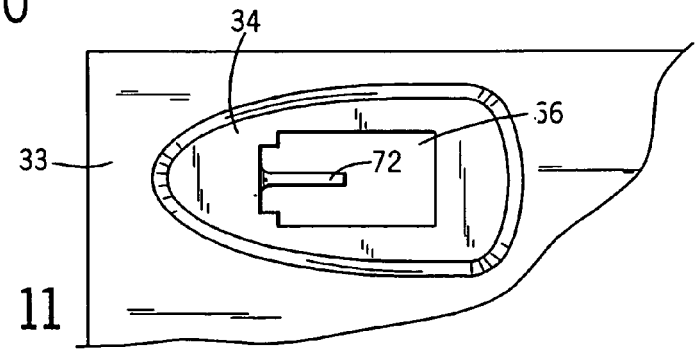
FIG. 11 is an elevational view of a portion of the exterior of a protective enclosure, according to a preferred embodiment of the present invention.
Figure 3A:
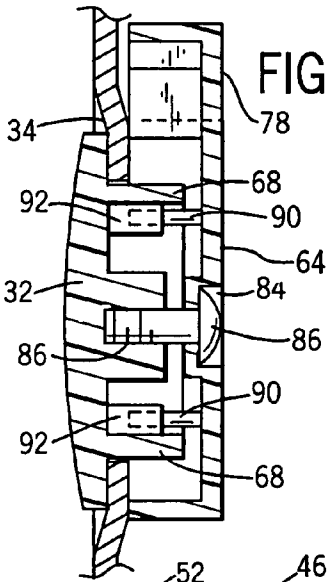
FIG. 3A is a cross-sectional view taken along line 3A—3A of FIG. 3.

Referring generally to FIGS. 3 and 3A, movable catch 30 also includes an inner member 64 secured to release switch 32, shown in dashed lines. As best illustrated in FIG. 11, inner member 64 is connected to release switch 32 through a hole 66 in chassis 22. Movable catch 30 includes a block portion 68 that extends through hole 66. Block 68 has a side opening 70 that allows movable catch 30 to travel along a guide member 72 formed in chassis 22. Block 68 could be disposed on release switch 32 or inner member 64. However, in the illustrated embodiment, block 68 is disposed on release switch 32. Chassis 22 also includes two tabs 74 that cooperate with block 68 and guide member 72 to secure a biasing spring 76.

Figure 12:
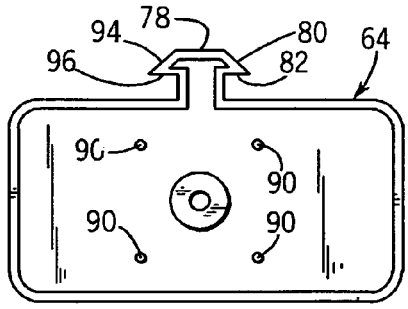
FIG. 12 is an elevational view of an inner member, illustrating the side of the inner member that faces the catch release, according to a preferred embodiment of the present invention.
Figure 9:
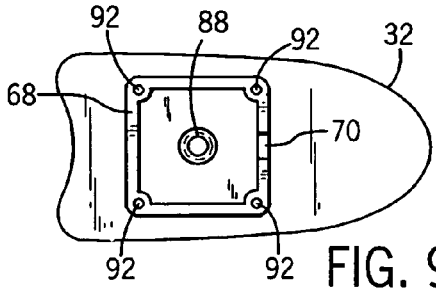
FIG. 9 is an elevational view of a catch release, illustrating the side of the catch release facing an inner member of a catch mechanism, according to a preferred embodiment of the present invention.

In the illustrated embodiment, inner member 64 includes a raised member 78 having an angled catch portion 80 and a flat catch portion 82. Inner member 64 also includes a hole 84 through which a screw 86 is inserted to secure inner member 64 to release switch 32. As best illustrated in FIG. 9, release switch 32 includes a corresponding threaded hole 88 into which screw 86 is threaded. As best illustrated in FIG. 12, inner member 64 includes four guideposts 90 that are configured for insertion into four guide holes 92 in central block 68.

Referring again to FIG. 3, the illustrated embodiment of raised member 78 includes a second angled catch portion 94 and a second flat catch portion 96. Second angled catch portion 94 and second flat catch portion 96 are symmetrical about an axis with angled catch portion 80 and flat catch portion 82. The symmetry of inner member 64 allows a single design to be used on opposite sides of chassis 22.

In the exemplary embodiment, two movable catches 30 are used to secure access panel 28 to chassis 22. The operation of each movable catch 30, preferably, is identical. Therefore, for clarity the following discussion of the operation of movable catch 30 will refer only to a single movable catch 30.

Referring generally to FIGS. 4 and 4A, as access panel 28 is being closed, angled latch portion 42 of access panel 28 contacts first angled catch portion 80 of inner member 64. In this view, as access panel 28 is pivoted downward, angled latch portion 42 forces inner member 64 to the right, causing spring 76 to be compressed. Angled latch portion 42 of access panel 28 slides along the surface of angled catch portion 80 as it forces inner member 64 to the right.

Referring generally to FIG. 5, access panel 28 eventually pivots to a point where angled latch portion 42 no longer engages angled catch portion 80. When that point is reached, the force of compression in spring 76 pushes block 68 to the left towards a biased position. The movement of movable catch 30 to the biased position causes flat catch portion 82 to be placed over flat latch portion 44. Flat catch portion 82 blocks movement of flat latch portion 44. The flat catch portions 82 of two movable catches 30 and lip 38 thus cooperate to secure access panel 28 to chassis 22. Additionally, the spring force of leaf spring 62 must be overcome to place access panel 28 in the closed position.

Referring generally to FIGS. 6 and 6A, release switch 32 is operated to displace movable catch 30 from the biased position to gain access to chassis 22. An operator displaces movable catch 30 laterally to remove flat catch portion 82 from its blocking position over flat latch portion 44. As best illustrated in FIG. 6A, the force of leaf spring 62 then forces edge 98 of access panel 28 upward. This makes it easier for an operator to grab access panel 28 and remove it from chassis 22.

Figure 7A:
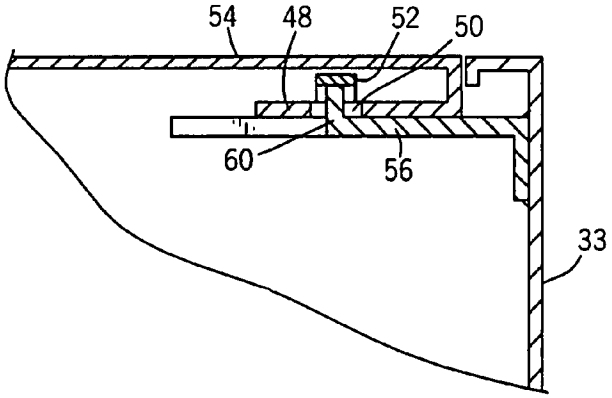
FIG. 7A is a cross-sectional view taken along line 7A—7A of FIG. 7.
Figure 7:
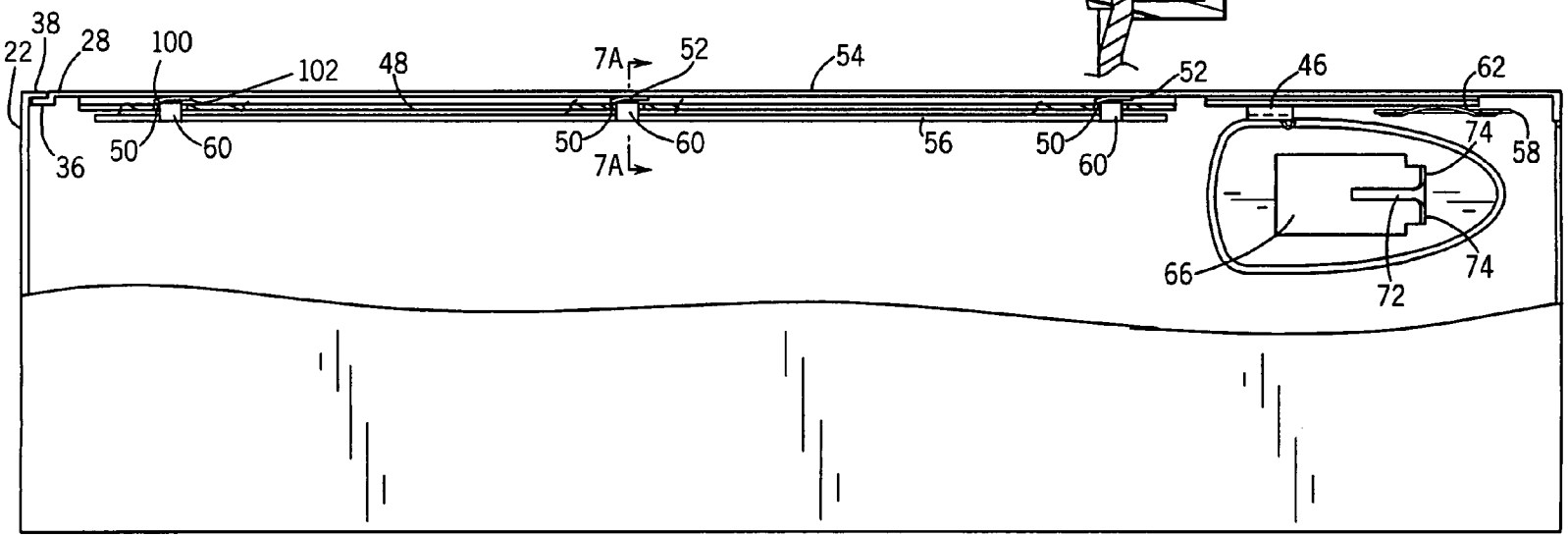
FIG. 7 is a cross-sectional view taken along line 7—7 of FIG. 2.

Referring generally to FIGS. 7 and 7A, electromagnetic shielding for enclosure 20 is provided by a system of ground springs 52 and ground tabs 60. Each tab 60 on chassis 22 is inserted through a respective hole 50 in support 48 of access panel 28 when access panel 28 is installed in a closed position on chassis 22. In the illustrated embodiment, ground springs 52 are formed of a strip of metal fixed at one end 100 to support 48. Each tab 60 contacts a free end 102 of a respective ground spring 52, thus grounding panel 28 to chassis 22.

Referring generally to FIG. 8, a bottom view of access panel 28 is featured. Preferably, access panel 28 is made from a sheet metal. In the illustrated embodiment, latch 40 and support rails 48 are formed by a series of bending operations on the sheet metal of access panel 28.

Figure 10:
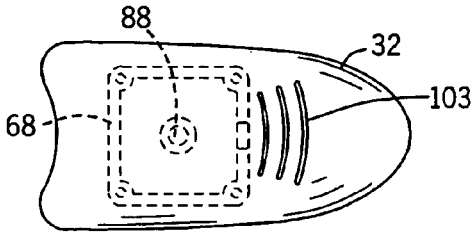
FIG. 10 is an elevational view of the catch release of FIG. 9, illustrating the side of the catch release that is visible from the exterior of a protective enclosure.

Referring generally to FIGS. 9 and 10, front and back views of the release switch 32 are illustrated. FIG. 9 illustrates the side of catch release 32 facing inner member 64. FIG. 10 illustrates the side of catch release 32 that is visible from the exterior of protective enclosure 20. Raised ridges 103 are provided on the outer surface of release switch 32 to enable an operator to more easily operate release switch 32.

Referring generally to FIG. 11, an exterior view is shown of base 22. This view illustrates recessed landing 34, hole 66, and guide member 72.

Figure 13:
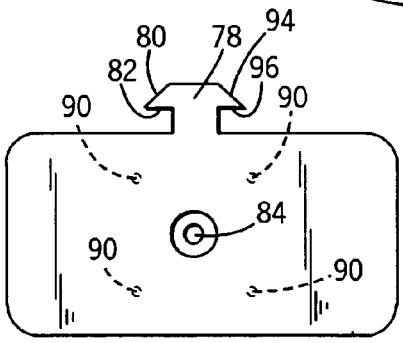
FIG. 13 is an elevational view of the inner member of FIG. 12, illustrating the side of the inner member that faces the interior of an enclosure.

Referring generally to FIGS. 12 and 13, front and back views of inner member 64 are illustrated. FIG. 12 illustrates the side of inner member 64 that faces catch release 32. FIG. 13 illustrates the side of the inner member that faces the interior of enclosure 20.

Referring generally to FIG. 14, an alternative embodiment of a chassis 104 is shown. In the illustrated embodiment, chassis 104 is configured so that movable catch 30 is proximate to front bezel 24 so that access panel 28 may be removed from the front of chassis 22, rather than the back.

It will be understood that the foregoing description is of preferred exemplary embodiments of this invention, and that the invention is not limited to the specific forms shown. For example, elements, such as latch 40 and brackets 56 and 58 described as portions of chassis 22 and access panel 28, may be formed separately and secured to chassis 22 and access panel 28. These and other modifications may be made in the design and arrangement of the elements without departing from the scope of the invention as expressed in the appended claims.

What is claimed is:

1. A protective assembly for a computer system, comprising:

a chassis;

an access panel;

a first and a second latch member secured to the access panel;

a first and a second catch member moveably secured to the chassis, wherein the first catch member is disposed on an interior side of a first sidewall of the chassis to secure the first latch member and the second catch member is disposed on an interior side of a second sidewall of the chassis, opposite the first sidewall, to secure the second latch member, the first and second catch members being biased in a first direction to secure the first and second latch members and being movable in a second direction to release the first and second latch members; and a first and a second operator, wherein the first operator is disposed on an exterior side of the first sidewall and secured through the chassis to the first catch member and the second operator is disposed on an exterior side of the second sidewall, the first and second operators being adapted to move the first and second catch members in the second direction to disengage with respect to the first and second latch members.

2. The system as recited in claim 1, wherein the latch member includes a first engaging portion and a first securing portion and the catch member includes a second engaging portion and a second securing portion, the first and second engaging portions being adapted to enable the first securing portion engage the second securing portion to displace the catch member, the first and second securing portions being adapted to enable the second securing portion capture the first securing portion.

3. The system as recited in claim 2, wherein the first engaging portion slidingly engages the second engaging portion and displaces the catch member in the second direction as the access panel is moved to a closed position on the chassis.

4. The system as recited in claim 3, wherein at the closed position, the first engaging portion and the second engaging portion are no longer in sliding engagement and the catch member is biased in the first direction.

5. The system as recited in claim 2, wherein the second securing portion is disposed over the first securing portion when the catch member is in a first position.

6. The system as recited in claim 2, wherein the first securing portion and the second securing portion are flat with respect to the access panel in a closed position in relation to the chassis.

7. The system as recited in claim 2, wherein the first engaging portion and the second engaging portion are angled with respect to the access panel in a closed position in relation to the chassis.

8. The system as recited in claim 6, wherein the latch member is releaseable from the catch member by displacing the catch member such that the second securing portion is not disposed over the first securing portion.

9. The system as recited in claim 1, wherein the catch member is biased in the first direction by a spring.

10. The system as recited in claim 2, wherein each catch member includes a third engaging portion and a third securing portion symmetrical about an axis with the second engaging portion and the second securing portion, the second securing portion being adapted to capture the first securing portion of the first latch member when the catch member is disposed on the first sidewall of the chassis and the third securing portion being adapted to capture the first securing portion of the second latch member when the catch member is disposed on the second sidewall of the chassis.

11. The system as recited in claim 2, wherein the first engaging portion and the second engaging portion are configured for sliding engagement with respect to one another.

12. The system as recited in claim 2, wherein the first securing portion and the second securing portion are configured for abutment with respect to one another.

13. The system as recited in claim 2, wherein the access panel is pivoted about a first end to position the access panel relative to the chassis.

14. The system as recited in claim 1, comprising a spring to bias the access panel to an open position.

15. A housing for a computer device, comprising:

a chassis configured to house at least one computer component, the chassis having a plurality of sidewalls;

an access panel coupleable to the chassis;

first and second latch members located on the access panel;

a first catch member moveably secured to the chassis on an interior side of a first sidewall of the chassis and configured to engage with the first latch member;

a second catch member moveably secured to the chassis on an interior side of a second sidewall and configured to engage with the second latch member, wherein the second sidewall is not adjacent to the first sidewall;

a first operator disposed on an exterior side of the first sidewall and coupled to the first catch member via a first extension member extending through the first sidewall; and a second operator disposed on an exterior side of the second sidewall and coupled to the second catch member via a second extension member extending through the second sidewall, wherein actuation of the first and second operators in a first direction disengages the first and second catch members from the first and second latch members respectively.

16. The housing as recited in claim 14, wherein the first and second catch members are slidably moveable.

17. The housing as recited in claim 15, wherein the first and second latch members are configured to bias the first and second catch members in the first direction via engagement between the first and second catch members and the first and second release members during positioning of the access panel in a closed position with respect to the chassis.

18. The housing as recited in claim 15, comprising a leaf spring coupled to the chassis and configured to bias the access panel away to an open position with respect to the chassis.

19. The housing as recited in claim 15, wherein the first and second catch members are substantially identical.

20. The housing as recited in claim 15, wherein the first and second catch members are interchangeable.

21. A housing for a computer device, comprising:

a chassis configured to house at least one computer component;

an access panel coupled to the chassis, wherein the access panel is pivotable with respect to the chassis;

first and second latch members located on the access panel;

a first catch member located on a first sidewall of the chassis and configured to engage with the first latch member, the first catch member being moveable in a first direction; and a second catch member located on a second sidewall not adjacent to the first sidewall and configured to engage with the second latch member, wherein the second catch member is moveable in the first direction, and wherein the first and second catch members are configured to disengage with the first and second latch members respectively via actuation of the first and second catch members in the first direction.

22. The housing as recited in claim 21, comprising a biasing mechanism configured to bias the first and second catch mechanisms in a second direction, wherein the second direction is axially opposite the first direction.

23. The housing as recited in claim 21, wherein the first and second catch members are substantially identical.

24. The housing as recited in claim 21, wherein the first and second catch members are interchangeable.

25. The housing as recited in claim 24, wherein the first and second latch members are configured to actuate the first and second catch members respectively in the first direction during positioning of the access panel to a closed position with respect to the chassis.

* * * * *

UNITED STATES PATENT AND TRADEMARK OFFICE

CERTIFICATE OF CORRECTION

PATENT NO. : 6,935,661 B1
APPLICATION NO. : 09/717544
DATED : August 30, 2005
INVENTOR(S) : Arthur K. Farnsworth et al.

It is certified that error appears in the above-identified patent and that said Letters Patent is hereby corrected as shown below:

In column 6, line 52, in Claim 16, delete "claim 14," and insert -- claim 15, --, therefor.

Signed and Sealed this

Fourteenth Day of September, 2010

David J. Kappos

David J. Kappos
*Director of the United States Patent and Trademark Office*